US006405381B1

(12) United States Patent
Bowman, Jr.

(10) Patent No.: US 6,405,381 B1
(45) Date of Patent: Jun. 18, 2002

(54) ARM STOCKINETTE AND METHOD OF USING THE SAME

(76) Inventor: Omer A. Bowman, Jr., 14737 Robinson, Overland Park, KS (US) 66223

( * ) Notice: Subject to any disclaimer, the term of this patent is extended or adjusted under 35 U.S.C. 154(b) by 0 days.

(21) Appl. No.: 09/682,020

(22) Filed: Jul. 10, 2001

(51) Int. Cl.[7] ..... A41D 1/00; A41D 19/00
(52) U.S. Cl. ..... 2/170; 2/16; 2/159; 2/161.1
(58) Field of Search ..... 2/16, 59, 159, 2/158, 161.1, 162, 170; 446/26, 327; 40/586

(56) References Cited

U.S. PATENT DOCUMENTS 1,227,052 A * 5/1917 Hogan
1,244,065 A * 10/1917 Miller
1,837,148 A * 12/1931 Davis
1,997,956 A * 4/1935 Whitaker
2,244,871 A * 6/1941 Guinzburg
4,856,112 A * 8/1989 Effle
5,143,762 A * 9/1992 Ho
5,878,435 A * 3/1999 Kast et al.
5,881,384 A * 3/1999 Williams
5,974,586 A * 11/1999 Reinoso
6,108,817 A * 8/2000 Kostelac
6,155,263 A * 12/2000 Weaver
6,272,688 B1 * 8/2001 Wilson

* cited by examiner

*Primary Examiner*—Rodney M. Lindsey
(74) *Attorney, Agent, or Firm*—Hovey Williams LLP

(57) ABSTRACT

Arm coverings (12, 14, 22–27) are provided which include an elongated, tubular, fabric body (28, 52, 66, 84, 94) presenting upper arm-receiving openings (30, 54, 68, 86, 96) as well as lower sections (36, 64, 72, 90, 98) which envelop an area in proximity to a user's wrist. Each covering (12, 14, 22–27) includes words or other indicia on the tubular bodies (28, 52, 66, 84, 94). In some forms, the words or indicia is located on the undersides of the tubular bodies (28, 52, 66, 84, 94) and becomes visible when the user's arms (16,18) are raised. Some coverings include couplers (34, 56, 70, 82, 90) which serve to hold the arm coverings in position. The coverings (12, 14, 22–27) may be worn by sports enthusiasts or others wishing to express themselves at a sporting event or the like by raising their arms.

21 Claims, 2 Drawing Sheets

ARM STOCKINETTE AND METHOD OF USING THE SAME

BACKGROUND OF INVENTION

1. Field of the Invention

The present invention is concerned with expressive arm coverings adapted to be worn by sports fans or others for decorative purposes. Each arm covering includes an elongated, tubular fabric body with words or other indicia visible thereon so that, when the wearer's arms are raised, the indicia becomes visible. Additionally, each arm covering may include additional ornamental accessories or indicia which is visible when a wearer's arms are in a relaxed position. For example, a football fan may have the words "TOUCH" and "DOWN" on a matched pair of arm coverings worn on the right and left arms respectively. When the fan's team scores a touchdown, the fan may raise his arms in exultation and delight, signaling to others his joy about the touchdown.

2. Description of the Prior Art

A number of gloves, arm coverings and other wear items have been provided in the past for various purposes. For example, U.S. Pat. No. 4,843,653 describes a wrist band including a towel-like portion which can be used to blot off perspiration from a user's face or forehead. The wrist band can be provided with logos or other desired indicia. U.S. Pat. No. 4,499,741 describes a sweatband having a non-distortable portion which may bear logos, names or trademarks thereon. U.S. Pat. No. D404,677 illustrates a wrist band provided with a logo region.

U.S. Pat. No. 5,1 68,576 discloses a protective device including foam modules which protect a user against impacts during sporting events. The foam may be decorated with trademarks and/or logos. U.S. Pat. No. 5,878,435 to Kast et al. describes a hand and forearm protector extending from approximately the base of the fingers to the elbow. The inventors indicate that the forearm protector may be decorated as desired.

U.S. Pat. No. 5,974,586 pertains to a wearable sleeve for blocking sunlight, in order to protect a wearer's arm against sunburn. Finally, U.S. Pat. No. D94,712 illustrates a glove including a monogrammed portion at the wrist and a design portion along the lower forearm.

With respect to forms of expression utilized by fans at sporting events, concerts, and the like, fans and spectators often adorn themselves in a variety of ways. Conventional adornments include clothing Items such as t-shirts and jackets which contain the name or logo of their selected team, a particular player on that team, band, or the like. In some instances, fans or spectators have applied body paint or ink to clothing and exposed areas of skin while other fans wear elaborate costumes. At any rate, all of these forms of expression are designed to signify the wearer's support for their chosen team, band, player, or the like.

SUMMARY OF INVENTION

The present invention provides unique arm coverings which are especially designed for use by sports enthusiasts or others wishing to express emotion by arm raising. The present invention is useful at events where verbal forms of expression are used as well as at events where silence is preferred while the event is occurring. Additionally, fans with hearing impairment will be able to participate in and sense other fans" exultation and delight to the same extent as fans without hearing impairment as the arm coverings provide an entirely non-verbal form of expression which is easily sensed and understood.

Broadly speaking, a covering in accordance with the invention includes an elongated, tubular fabric body having an upper end and an opposed lower end, with the upper end presenting an upper opening sized to receive and envelop the upper arm of a user between the user's elbow and shoulders. The lower end includes a lower section dimensioned to envelop the wrist of the user, and may be provided with a variety of terminal arrangements, such as a full-glove or partial-glove design. In some forms, at least one coupler is provided to maintain the tubular body in place on the user's arm. This coupler may be located adjacent the upper opening of the covering, the lower end of the covering, at both ends of the covering, or even along the covering between the two ends. Very importantly, indicia is provided on the tubular body between the upper and lower ends thereof. In some forms, the indicia is positioned such that it is visible when a wearer has their arms in a downward position, thereby rendering the indicia visible to surrounding fans. In preferred forms, the indicia is positioned longitudinally along the underside of the tubular body such that, upon a wearer raising their arms, this indicia becomes immediately visible and is readable vertically from the lower end to the upper end. Other embodiments may include additional adornment on the fabric body such as flexible rubberized spikes on the full-glove or partial-glove design or any other ornamentation that a fan may choose to show support for his team.

A variety of coupling devices can be used with the arm coverings of the invention, e.g., elastic bands or velcro strips. These can be provided not only at the upper end of the covering, but also at or adjacent the lower end thereof. In other forms, a substantial portion of the tubular body is formed of elastic material thereby providing the tubular body with a desired amount of stability once it is pulled on and worn. The elastic portion of these forms of the invention comprises or is integrated into at least about 35% of the total area of the covering material. More preferably, at least 50% and more preferably at least 75% of the covering material comprises elastic or stretchable material or has such material integrated therein. Most preferably, this material comprises at least 98% of the covering material. The most preferable covering material of this form is elastic hose-like material.

Advantageously, arm coverings in accordance with the present invention can be worn next to the wearer's skin, with no underlying clothing or can be worn over the sleeves of another garment. These arm coverings can be provided with an amount of insulating material for use on cold days or can be formed of water repellant material for use on rainy or wet days. In some embodiments, the arm coverings will be sized to fit over other clothing items such as heavy winter coats. To facilitate the wearing of such arm coverings, the arm coverings may comprise material which is less elastic along the length thereof and have at least one coupler to maintain the arm covering's position on a wearer's arm. This could give the arm covering a loose-fitting appearance which is easily worn over other clothing items. In other embodiments the arm covering may comprise a material which is essentially transparent while the indicia located on the arm covering is opaque. This provides an arm covering which is not noticeable until a wearer positions their arms such that the indicia is visible to surrounding fans. For example, the indicia may be positioned on the underside of the arm covering so that it is only visible upon a wearer raising their arms. Thus, a variety of fabrics and materials can be used to construct these arm coverings and the particular choice of material may be influenced by weather conditions, style, and other clothing to be worn with the arm coverings.

Other advantages of the present invention include easy application and removal which is not possible with other types of adornment such as body paint or elaborate costumes. When a fan wishes to use the present invention, the arm covering is simply in pulled over the hand and into position. Removal of the arm covering is just as easy. Due to the simple construction of the present invention, it can be manufactured at a relatively low cost. This advantage is also in contrast to conventional forms of adornment.

It is understood that when the term "fans" or "spectators" is used, it is meant to embrace attendees at a variety of events including sporting events, concerts, ceremonies, and the like.

The term "coupler" includes elastic bands, various finger and hand openings, velcro straps, buttons, snaps, zippers, ties, and any other feature used to maintain the tubular body in place including the use of stretch material as a part of the arm covering itself.

Although the length of the arm coverings is variable depending upon style and considerations and the type of underside indicia desired, in general the coverings should extend over and cover at least about 35%, more preferably at least about 50%, of the length of the user's arm, between the wrist and shoulder.

DETAILED DESCRIPTION

The following description sets forth preferred embodiments of the present invention. It Is to be understood, however, that this description is provided for illustration only and nothing therein should be taken as a limitation upon the overall scope of the invention.

Figure 1:
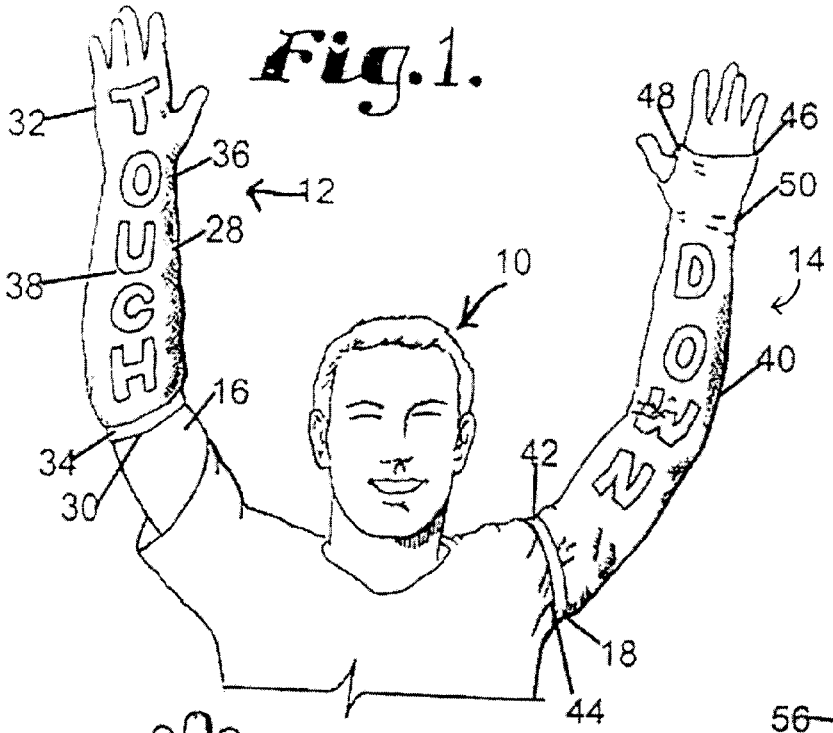
FIG. 1 is a fragmentary front view of a user wearing arm coverings in accordance with the invention, and with the user's arms raised to reveal the indicia on the undersides of the coverings.

Turning now to the drawings, FIG. 1 illustrates a male user 10 having differently configured arm coverings 12 and 14 on each of his arms 16 and 18. Similar coverings having differences in detail are depicted in FIGS. 3–7 as coverings 20, 22, 24, 26, and 27 respectively. In each case, the coverings 12, 14, 20, 22, 24, 26, and 27 include common components, e.g., an elongated tubular fabric body, an upper open end and a lower end, and indicia on the body. As depicted in FIG. 1, the coverings of the invention are designed to be worn on the user's arms in such a manner that when the user raises his arms, the indicia is visible.

Figure 2:
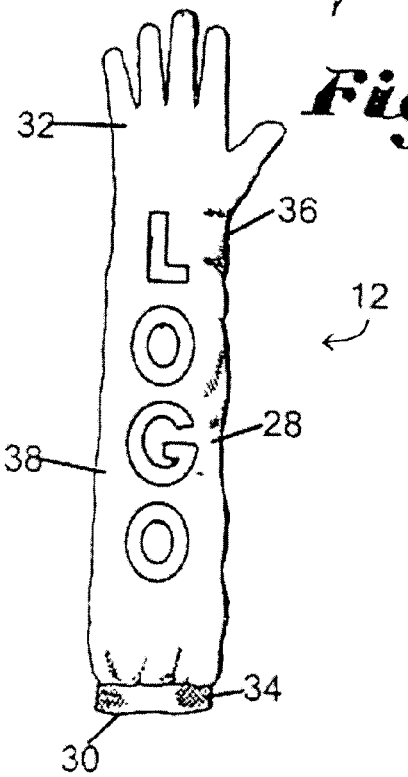
FIG. 2 is an elevational view of one form of arm covering in accordance with the invention, including a full-glove lower section.

In more detail, the covering 12 includes a tubular fabric body 28 with an upper opening 30 and a full-glove lower end 32. An upper coupler is provided in the form of an elastic band 34 which is designed so as to engage the upper arm of the user. The body is also configured to present a lower section 36 adjacent the full glove end 32 which is configured to envelop the user's wrist. In the embodiment of FIG. 1, it will be seen that the word ATOUCH@ is provided on the underside 38 of the body 28. More generally, and as shown in FIG. 2, the underside 38 may be provided with any desired indicia such as a commercial logo or other word(s).

The covering 14 includes tubular fabric body 40 which in this instance extends further along the length of the user's arm 18, to a point adjacent the user's shoulder as shown. The covering 14 has an elastic band upper coupler 42 disposed about the upper open end 44 thereof, whereas the lower end of the body 40 is open as at 46 to present a half-glove configuration. In this design, a thumb hole 48 is also provided to accommodate the user's thumb as shown. Again, a conforming lower section 50 above opening 46 envelops the wrist of the user's arm. As illustrated in FIG. 1, the underside of the body 40 is emblazoned with the word "DOWN." Thus, when the user 10 wearing coverings 12 and 14 raises his arms, the word "TOUCH DOWN" is visible.

Figure 3:
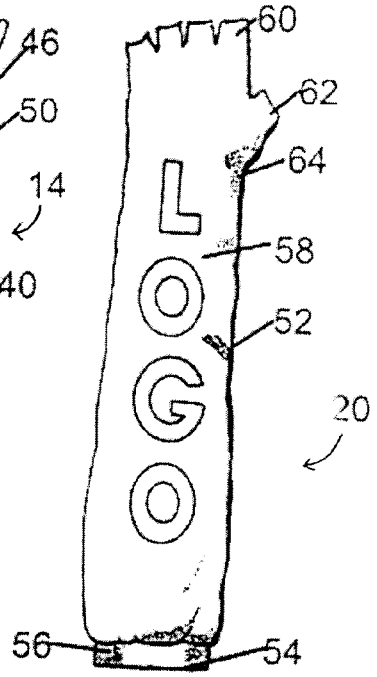
FIG. 3 is a view similar to that of FIG. 2, but depicting another style of arm covering making use of a half glove and thumb hole opening on the lower end of the covering.

In FIG. 3, the tubular body 52 has an upper opening 54 with a surrounding elastic upper coupler 56, and indicia 58 imprinted on the underside of the body 52. The lower end of the body includes a similar half-glove design, but with short finger openings 60 and an open thumb extension 62. The lower section 64 again envelops the user's wrist.

Figure 4:
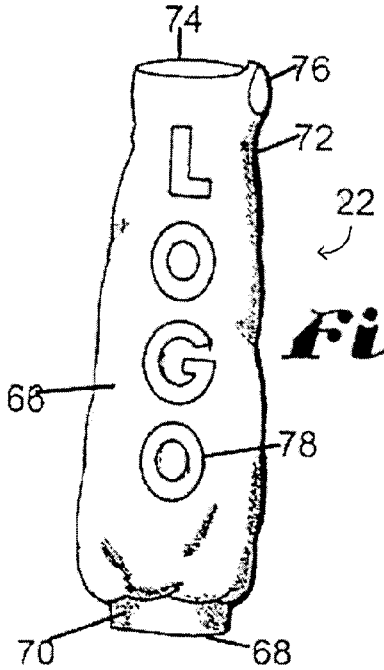
FIG. 4 is a view similar to that of FIG. 2, but depicting an arm covering including a lower opening permitting full passage of the user's hand therethrough, and with a thumb hole adjacent the lower opening.

FIG. 4 depicts the covering 22, including tubular fabric body 66 presenting an upper opening 68 and a surrounding elastic band coupler 70. The lower end of the covering is defined by a wrist-engaging lower section 72, a lower opening 74 and a thumb hole 76. Again, the underside of the body 66 includes indicia 78.

Figure 5:
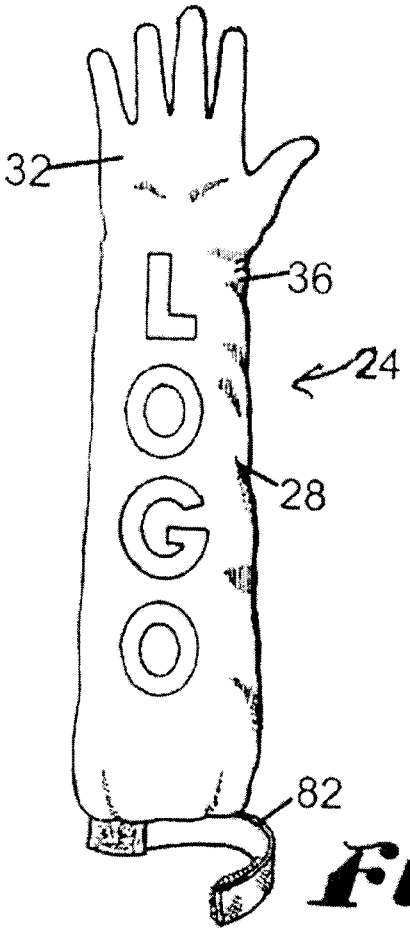
FIG. 5 is a view similar to that of FIG. 2, but showing the use of a velcro upper coupler.

FIG. 5 illustrates the covering 24, which is identical to covering 22 described above, save for the provision of an upper coupler in the form of an elongated, interconnectable velcro band 82. This band may be pulled as necessary and interconnect by the mating velcro ends to provide an effective upper coupler.

Figure 6:
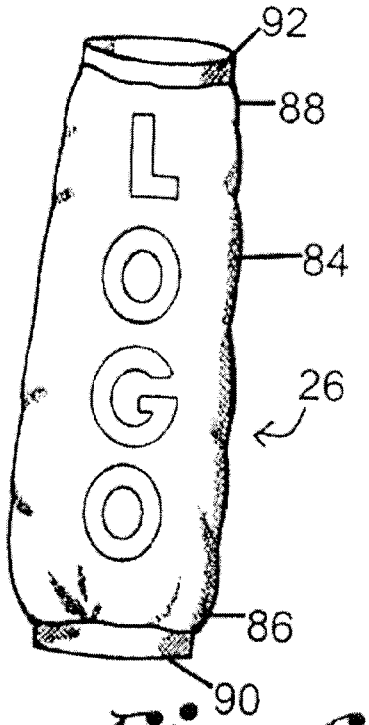
FIG. 6 is a view similar to that of FIG. 2, depicting elastic couplers at the upper and lower ends of the arm covering.

FIG. 6 depicts a still further covering 26 including elongated tubular body 84 presenting upper and lower ends 86 and 88, each having a corresponding elastic band coupler 90, 92. It will be observed that the covering 26 is not provided with either a thumb hole or partial or complete glove ending, but rather terminates adjacent the user's wrist. In this fashion, the lower wrist-conforming section of the body is effectively coincident with the lower end 88 thereof. In this embodiment, the indicia (noted as "LOGO") is positioned such that it may be worn so that the indicia is visible when a wearer's arms are either raised or lowered. Alternatively, the indicia may be provided on both sides of the covering 26 so that the indicia is visible when the wearer'" arms are raised and when they are lowered.

Figure 7:
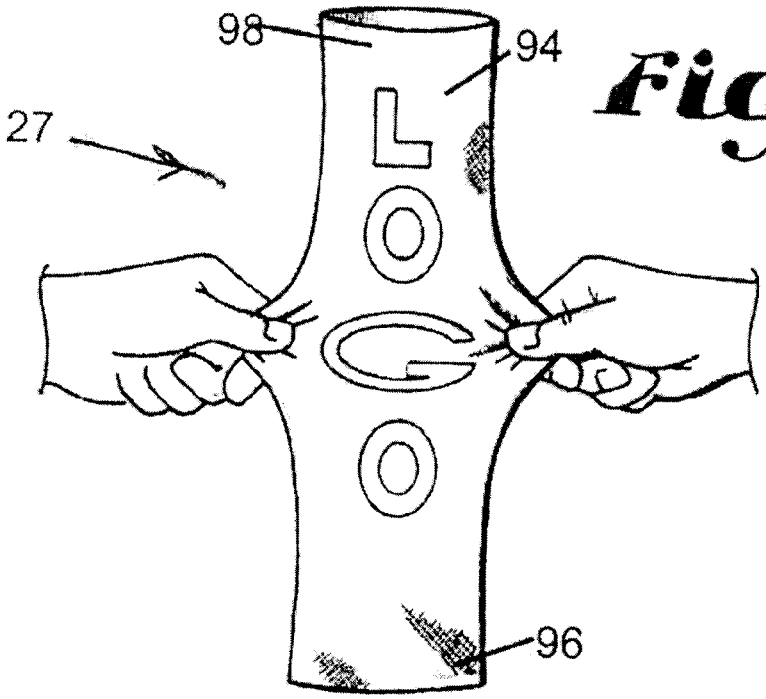
FIG. 7 is an elevational view of one form of arm covering in accordance with the present invention depicting the integration of stretch material throughout the length of the arm covering.

Finally, FIG. 7 depicts covering 27 including elongated tubular body 94 presenting upper and lower ends 96 and 98. Tubular body 94 is constructed using stretchable or elastic materials throughout a substantial portion thereof. This type of construction permits covering 27 to remain positioned on a wearer without the use of couplers due to the stretchable material's constrictive nature about an arm.

It will be appreciated that all of the coverings 12, 14 and 20–27 are designed so that they are worn on a user's arm. In each case an upper open end is provided which is sized to envelop the user's upper arm between the forearm and shoulder. This upper end is also provided with a coupler for coverings 12, 14, and 20–26 which serves to maintain the tubular body in place on the user's arm. Couplers are not provided on covering 27 due to the elastic nature of tubular body 94. In addition, each such covering has a lower section dimensioned to envelop the wrist of the user and may include a lower coupler at this point. Finally, all of the depicted coverings include indicia of desired type and content which is visible when the arm(s) of the user are raised. Thus, the present invention provides an effective, low cost, creative method of expression that is particularly adapted for fans and spectators of all sports and events.

What is claimed is:

1. An arm covering comprising an elongated, tubular fabric body having an upper end and a lower end, said upper end presenting an upper opening sized to envelop the upper arm of a user between the user's elbow and shoulder, said lower end presenting a lower section dimensioned to envelop the wrist of said user, a first coupler operable to maintain the covering in place on the user's arm, and indicia provided on the body between said upper end and said lower section.

2. The covering of claim 1, said indicia being located on the underside of said body such that said indicia become visible when the user's arm is raised.

3. The covering of claim 1, said first coupler being adjacent said upper opening.

4. The covering of claim 1, said first coupler comprising a band of elastic material.

5. The covering of claim 1, said first coupler comprising mating velcro sections.

6. The covering of claim 1, said first coupler comprising stretch material integrated into at least 35% of the total area of said body.

7. The coupler of claim 6, said stretch material being integrated into at least about 50% of the total area of said body.

8. The covering of claim 1, said lower end presenting a lower opening adjacent said lower section, said lower opening permitting a portion of the user's hand to extend outwardly from the lower opening.

9. The covering of claim 8, including a thumb hole adjacent said lower opening.

10. The covering of claim 1, said lower end including a glove section adapted to receive the hand of the user.

11. The covering of claim 1, including a second coupler adjacent said lower section.

12. The covering of claim 11, said second coupler comprising an elastic band.

13. The covering of claim 1, said body comprising a material selected from the group consisting of cloth materials, polyester materials, elastic materials, insulated materials, water repellant materials, and combinations thereof.

14. A method of expression comprising the steps of donning the arm covering of claim 2, and raising the arm to render visible said indicia.

15. A method of expression comprising donning the arm covering of claim 1 and rendering the indicia thereon visible.

16. A unitary tubular body of elastic material having an inside and an outside, said body encircling the arm of a wearer with said inside proximate to the arm, said body further having a first end and an opposed second end, said first end including an opening adapted for the insertion of a wearer's arm therein; said body extending between a wearer's wrist and a, said indicia being oriented each that upon a wearer raising their arms, said indicia becomes visible location between the wearer's shoulder and elbow and further including indicia thereon.

17. The body of claim 16, said body comprising at least about 50% stretchable material.

18. The body of claim 16, said second end being glove-shaped.

19. The body of claim 16, said second end including an opening adapted for the insertion of a wearer's arm therethrough.

20. The body of claim 16, said first end including a coupler.

21. The body of claim 16, said second end including a coupler.

* * * * *

UNITED STATES PATENT AND TRADEMARK OFFICE

CERTIFICATE OF CORRECTION

PATENT NO. : 6,405,381 B1
APPLICATION NO. : 09/682020
DATED : June 18, 2002
INVENTOR(S) : Omer A. Bowman, Jr.

It is certified that error appears in the above-identified patent and that said Letters Patent is hereby corrected as shown below:

Col. 6, line 27, of claim 16: delete “, said indicia being oriented each that upon a wearer raising their arms, said indicia becomes visible” and substitute “, said indicia being oriented such that upon a wearer raising their arms, said indicia becomes visible” after the word “thereon.”

Signed and Sealed this
Third Day of July, 2012

David J. Kappos

David J. Kappos
*Director of the United States Patent and Trademark Office*